US011742136B2

(12) United States Patent
Kim et al.

(10) Patent No.: US 11,742,136 B2
(45) Date of Patent: Aug. 29, 2023

(54) COIL COMPONENT

(71) Applicant: SAMSUNG ELECTRO-MECHANICS CO., LTD., Suwon-si (KR)

(72) Inventors: Young Sun Kim, Suwon-si (KR); Sung Hee Kim, Suwon-si (KR); In Suk Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 383 days.

(21) Appl. No.: 16/919,613

(22) Filed: Jul. 2, 2020

(65) Prior Publication Data

US 2021/0110968 A1 Apr. 15, 2021

(30) Foreign Application Priority Data

Oct. 15, 2019 (KR) ..... 10-2019-0127514

(51) Int. Cl.

| | |
|---|---|
| ***H01F 27/36*** | (2006.01) |
| ***H01F 27/24*** | (2006.01) |
| ***H01F 27/28*** | (2006.01) |
| ***H01F 27/32*** | (2006.01) |

(Continued)

(52) U.S. Cl.

CPC ..... *H01F 27/36* (2013.01); *H01F 27/24* (2013.01); *H01F 27/2804* (2013.01); *H01F 27/324* (2013.01); *H01F 41/041* (2013.01); *H01F 41/12* (2013.01); *H01F 2027/2809* (2013.01)

(58) Field of Classification Search

CPC ..... H01F 27/36; H01F 27/24; H01F 27/2804; H01F 27/324; H01F 41/041; H01F 41/12; H01F 2027/2809; H01F 17/0013; H01F 2017/048; H01F 17/04; H01F 37/361; H01F 27/363; H01F 27/366; H01F 27/33; H01F 27/34; H01F 27/341; H01F 27/343; H01F 27/345; H01F 27/346; H01F 2027/348; H01F 27/361

See application file for complete search history.

(56) References Cited

U.S. PATENT DOCUMENTS 6,476,689 B1 * 11/2002 Uchida ..... H03H 7/0115 333/185
10,111,330 B2 * 10/2018 Ueda ..... H05K 3/24

(Continued)

FOREIGN PATENT DOCUMENTS

| | | | |
|---|---|---|---|
| JP | 2005-317604 | A | 11/2005 |
| KR | 10-2017-0026135 | A | 3/2017 |
| KR | 10-2017-0037517 | A | 4/2017 |

*Primary Examiner* — Mohamad A Musleh
*Assistant Examiner* — Matthew T Sarles
(74) *Attorney, Agent, or Firm* — Morgan, Lewis & Bockius LLP

(57) ABSTRACT

A coil component includes a support substrate including a through-hole disposed therein; a body including the support substrate embedded therein, and having a core disposed in the through-hole of the support substrate; a coil portion disposed on the support substrate, embedded in the body, and having a plurality of turns with reference to the core as an axis on the support substrate; and a shielding pattern disposed between an internal wall of the support substrate, by which the through-hole is defined, and the core.

20 Claims, 6 Drawing Sheets

(51) Int. Cl.
*H01F 41/04* (2006.01)
*H01F 41/12* (2006.01)

(56) References Cited

U.S. PATENT DOCUMENTS

| | | | | |
|---|---|---|---|---|
| 2003/0188886 | A1* | 10/2003 | Fey | H05K 3/242 430/394 |
| 2014/0292469 | A1* | 10/2014 | Cha | H01F 17/0013 336/200 |
| 2017/0040101 | A1* | 2/2017 | Jeong | H01F 27/2804 |
| 2017/0063322 | A1* | 3/2017 | Matsunaga | H01F 27/292 |
| 2017/0092413 | A1* | 3/2017 | Matsunaga | H01F 27/2804 |
| 2019/0311831 | A1* | 10/2019 | Yeo | H01F 41/042 |

* cited by examiner

COIL COMPONENT

CROSS-REFERENCE TO RELATED APPLICATION(S)

The present application claims the benefit of priority to Korean Patent Application No. 10-2019-0127514, filed on Oct. 15, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in electronic devices, together with a resistor and a capacitor.

As an electronic device has been designed to have high performance and a reduced size, the number of coil components used in an electronic device has been increased, and the sizes of coil components have been reduced.

Accordingly, there has been increasing demand for removing noise such as electromagnetic interference (EMI) of a coil component.

SUMMARY

An aspect of the present disclosure is to provide a coil component which may prevent significant reduction of a volume of a magnetic material when noise generated by components and/or transferred to components is removed.

According to an aspect of the present disclosure, a coil component includes a support substrate including a through-hole disposed therein; a body including the support substrate embedded therein, and having a core disposed in the through-hole of the support substrate; a coil portion disposed on the support substrate, embedded in the body, and having a plurality of turns with reference to the core as an axis on the support substrate; and a shielding pattern disposed between an internal wall of the support substrate, by which the through-hole is defined, and the core.

According to another aspect of the present disclosure, a coil component includes a support substrate including a through-hole disposed in a central portion thereof; a coil portion disposed on the support substrate; a shielding pattern disposed along an internal wall of the support substrate by which the through-hole is defined; an insulating layer disposed between the support substrate and the coil portion, and extending to at least a portion of a surface of the shielding pattern; and a body including the support substrate, the coil portion, the shielding pattern, and the insulating layer, wherein a portion of the body is disposed in a remaining space of the through-hole in which the shielding pattern is disposed.

According to another aspect of the present disclosure, a coil component includes a support substrate including a through-hole disposed therein; a body including the support substrate embedded therein, and having a core disposed in the through-hole of the support substrate; a coil portion disposed on the support substrate and embedded in the body; a shielding pattern disposed between an internal wall of the support substrate, by which the through-hole is defined, and the core; first and second external electrodes disposed on both end surfaces of the body and connected to opposing ends of the coil portion; and a third external electrode disposed on an external surface of the body and spaced apart from the first and second external electrodes, wherein the shielding pattern extends and penetrates the support substrate to be exposed to the external surface of the body and connected to the third external electrode.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
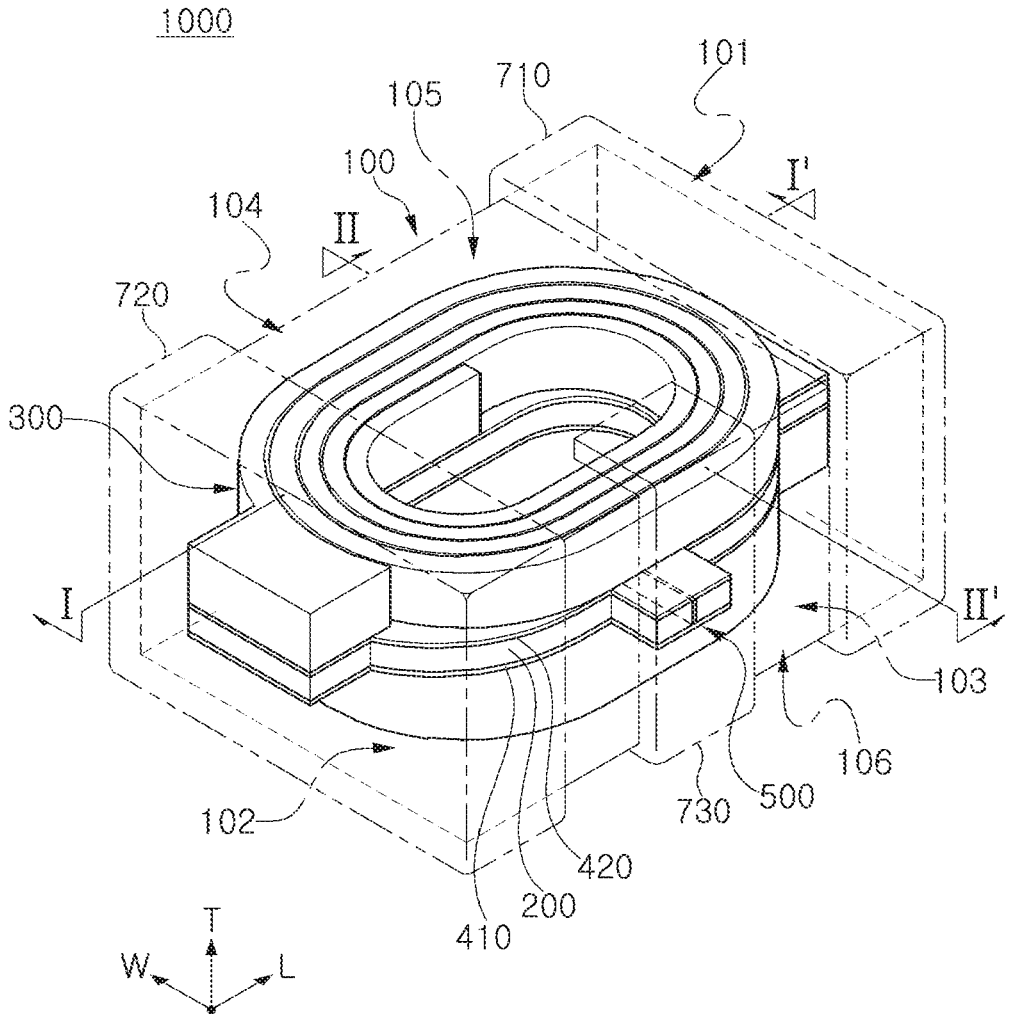
FIG. 1 is a diagram illustrating a coil component according to a first embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
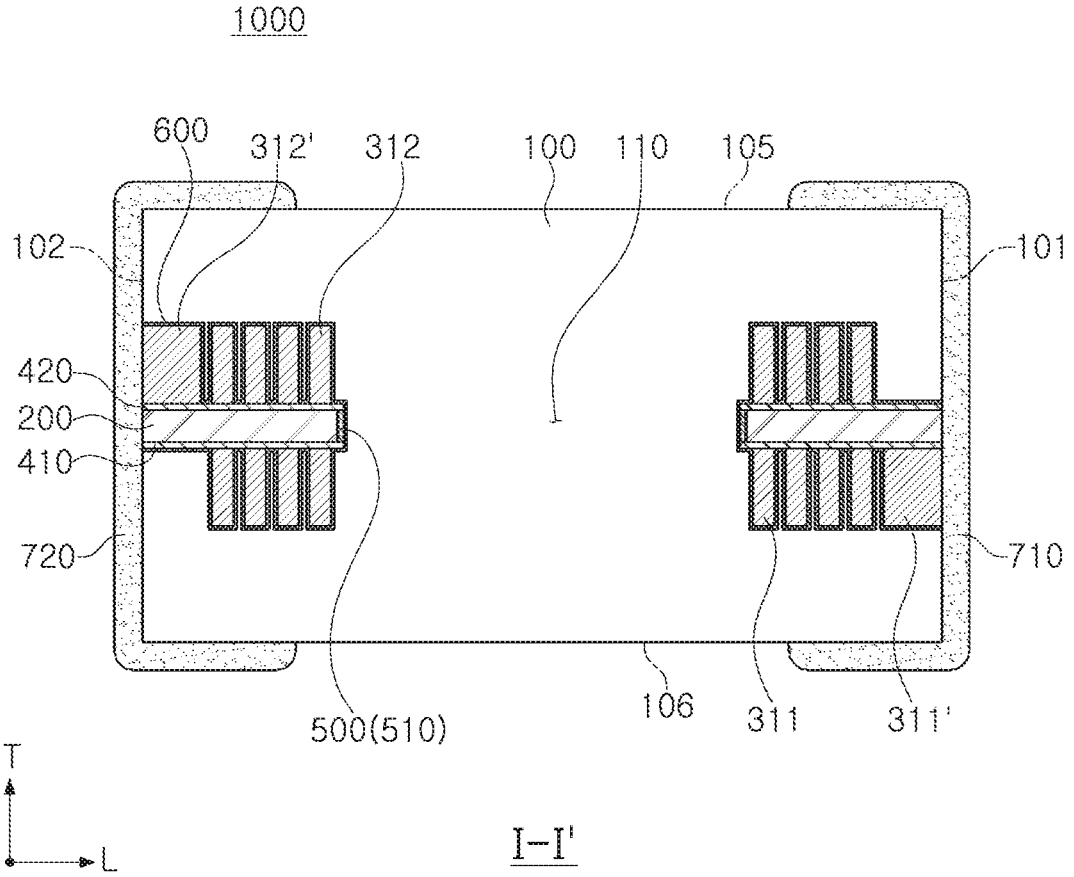
FIG. 2 is a cross-sectional diagram taken along line I-I' in FIG. 1.
Figure 3:
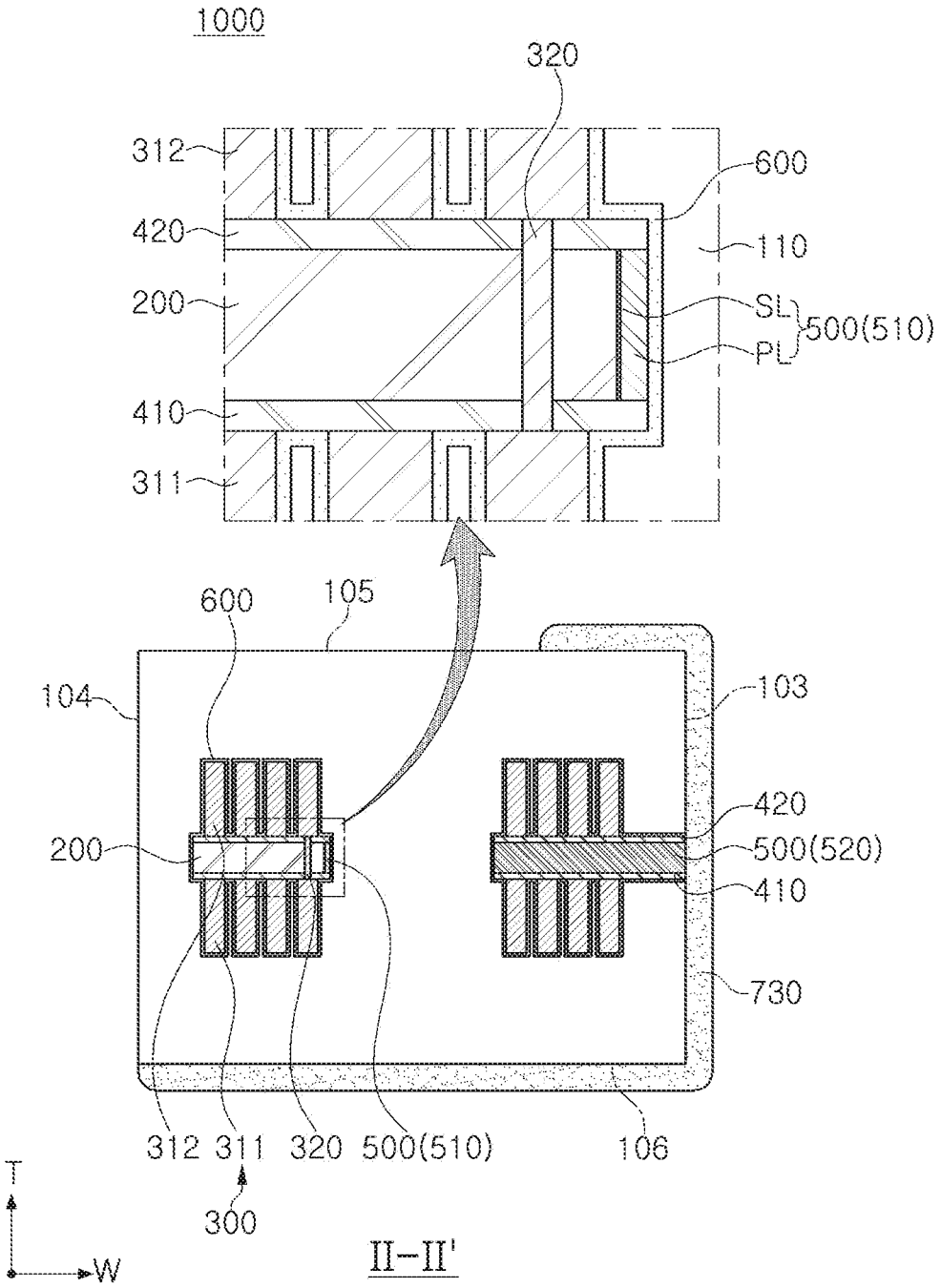
FIG. 3 is a cross-sectional diagram taken along line II-II' in FIG. 1.
Figure 4:
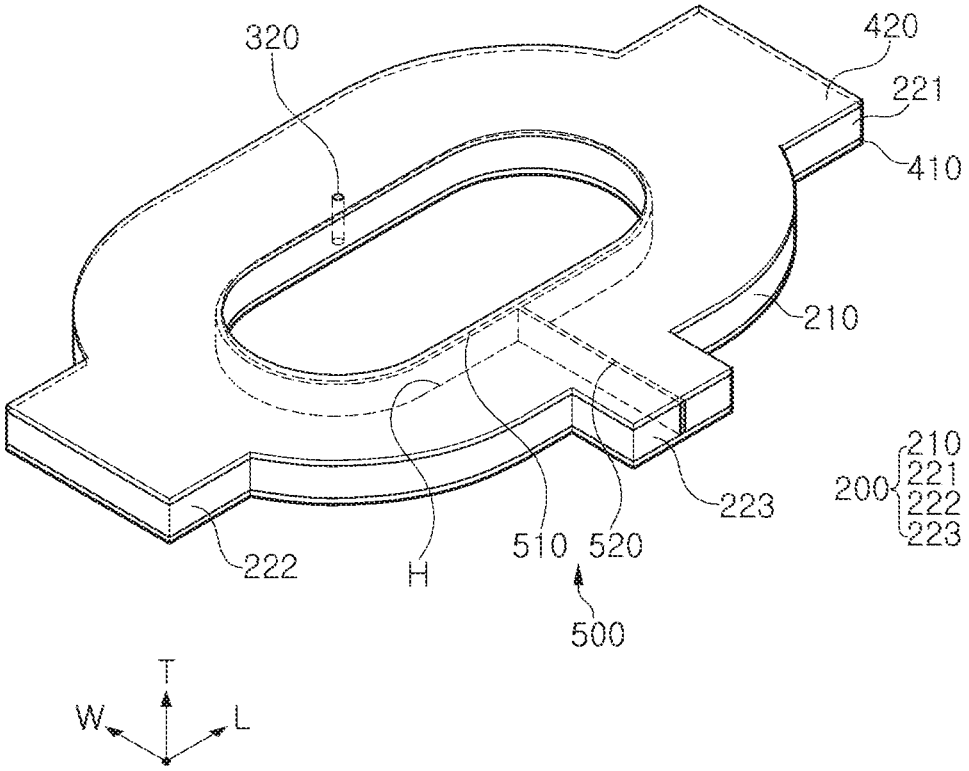
FIG. 4 is a diagram illustrating an internal structure of a coil component according to a first embodiment of the present disclosure.

FIG. 1 is a diagram illustrating a coil component according to a first embodiment. FIG. 2 is a cross-sectional diagram taken along line I-I' in FIG. 1. FIG. 3 is a cross-sectional diagram taken along line II-II' in FIG. 1. FIG. 4 is a diagram illustrating an internal structure of a coil component according to a first embodiment. FIG. 4 illustrates the coil component including the elements other than a coil portion, a body, and an insulating film.

Referring to FIGS. 1 to 4, a coil component 1000 in the first embodiment may include a body 100, a support substrate 200, a coil portion 300, insulating layers 410 and 420, and a shielding pattern 500, and may further include an insulating film 600 and external electrodes 710, 720, and 730.

The body 100 may form an exterior of the coil component 1000 in one embodiment, and the support substrate 200 and the coil portion 300 may be embedded in the body 100.

The body 100 may have a hexahedral shape.

As illustrated in FIGS. 1 to 5, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100 to each other. In the description below, both end surfaces of the body may refer to the first surface 101 and the second surface 102 of the body 100, and both side surfaces of the body may refer to the third surface 103 and the fourth surface 104 of the body 100. Also, one surface and the other surface of the body 100 may refer to the sixth surface 106 and the fifth surface 105 of the body 100, respectively.

The body 100 may be formed such that the coil component 1000 in which the external electrodes 710, 720, and 730 are formed may have a length of 2.0 mm, a width of 1.2 mm, and a thickness of 0.65 mm, for example, but an example embodiment thereof is not limited thereto. The above-mentioned sizes are example sizes determined without consideration of a process error, and the like, and an example of the sizes is not limited thereto.

The body 100 may include a magnetic material and resin. For example, the body 100 may be formed by layering one or more magnetic composite sheets including resin and a magnetic material dispersed in resin. Alternatively, the body 100 may have a structure different from the structure in which a magnetic material is dispersed in resin. For example, the body 100 may be formed of a magnetic material such as ferrite.

The magnetic material may be ferrite or a magnetic metal powder.

The ferrite powder may include, for example, one or more materials of a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example embodiment of the magnetic metal powder is not limited thereto.

Each particle of the ferrite and the magnetic metal powder may have an average diameter of 0.1 μm to 30 μm, but an example of the average diameter is not limited thereto.

The body 100 may include two or more types of magnetic materials dispersed in resin. The notion that types of the magnetic materials are different may indicate that one of an average diameter, a composition, crystallinity, and a form of a magnetic material disposed in a resin is different from those of the other magnetic material(s).

The resin may include one of epoxy, polyimide, a liquid crystal polymer, or mixtures thereof, but the example of the resin is not limited thereto.

The body 100 may include a core 110 penetrating the support substrate 200, the coil portion 300, and the shielding pattern 500. The core 110 may be integrated with the body 100, but an example embodiment thereof is not limited thereto. When the core 110 is integrated with the body, the core 110 may be one region of the body 100 with which the core 110 is integrated. The core 110 may be disposed in a remaining space of a through-hole H of the support substrate 200 in which a central portion 510 of the shielding pattern 500 is disposed.

The support substrate 200 may support the coil portion 300, and may be embedded in the body 100. The through-hole H may be formed in the support substrate 200. The support substrate 200 may be configured to penetrate the support substrate 200 in the thickness direction T of the body 100.

The shielding pattern 500 may be disposed on the support substrate 200 to emit noise transferred to the components and/or noise generated from the components to a mounting substrate, or the like. For example, the shielding pattern 500 may include the central portion 510 disposed between an internal wall of the support substrate 200 forming the through-hole H and a core 110 of the body 100, and a connection portion 520 extending from the central portion 510 to the third surface 103 of the body 100. The connection portion 520 may be in contact with and connected to the third external electrode 730 disposed on the third surface 103 of the body 100. When the coil component 1000 is mounted on a mounting substrate, or the like, in one embodiment, the third external electrode 730 may be electrically connected to a ground of the mounting substrate, or the like. Due to such a structure, the shielding pattern 500 may emit the noise transferred to the components and/or noise generated from the components to the mounting substrate, or the like. In the description below, the internal wall of the support substrate 200 forming the through-hole H may be considered the same as an internal wall of the through-hole H.

The central portion 510 of the shielding pattern 500 may be formed along the internal wall of the through-hole H and may form a closed-loop in the through-hole H. Accordingly, the central portion 510 of the shielding pattern 500 may be consecutively formed on the internal wall of the through-hole H in a form corresponding to a shape of the through-hole H.

The connection portion 520 of the shielding pattern 500 may fill a slit configured to penetrate a third end portion 223 of the support substrate 200 in the thickness direction T of the body 100 and to extend to the third surface 103 of the body 100. The shape of the connection portion 520 of the shielding pattern 500 illustrated in FIG. 4 is merely an example, and differently from the example illustrated in FIG. 4, the connection portion 520 may not fill an internal space of the slit, and may be configured as a conformal film formed along an internal wall of the slit.

A thickness (a length of the shielding pattern 500 in the direction T with reference to the direction illustrated in FIGS. 2 and 3) of the shielding pattern 500 may correspond to a thickness (a length of the support substrate 200 in the direction T with reference to the direction illustrated in FIGS. 2 and 3) of the support substrate 200. The shielding pattern 500 may have a thickness substantially the same as a thickness of the support substrate 200 on the internal wall of the through-hole H. Alternatively, differently from the example illustrated in FIGS. 2 and 3, a thickness of the shielding pattern 500 may be greater than a thickness of the support substrate 200. Even in the latter example, the shielding pattern 500 may not extend to an upper surface and a lower surface of the support substrate 200 with reference to the direction illustrated in FIGS. 2 and 3.

The shielding pattern 500 may include a seed layer SL disposed on the internal wall of the through-hole H of the support substrate 200, and a plating layer PL disposed on the seed layer SL. Accordingly, the shielding pattern 500 may be formed along the internal wall of the through-hole H through an electrolytic plating process. In this sense, the central portion 510 of the shielding pattern 500 may be formed similarly to a plated through-hole (PTH). The seed layer SL may be formed by an electroless plating process, and the plating layer PL may be formed by an electrolytic plating process. The seed layer SL and the plating layer PL may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto. As an example, both of the seed layer SL and the plating layer PL may be formed of copper (Cu), but an example embodiment thereof is not limited thereto. The seed layer SL and the plating layer PL may be formed of different conductive materials.

The support substrate 200 may include a support portion 210 and first to third end portions 221, 222, and 223. The through-hole H may be formed in the support portion 210, and the central portion 510 of the shielding pattern 500 may be disposed therein. The first and second end portions 221 and 222 may support first and second lead-out portions 311' and 312' of the coil portion 300. The connection portion 520 of the shielding pattern 500 may be formed on the third end portion 223. The support portion 210 and the first to third end portions 221, 222, and 223 may be integrated with and connected to each other. Accordingly, the support portion 210 and the first to third end portions 221, 222, and 223 may be processed using a single material such that a boundary may not be formed therebetween. The first end portion 221 may extend from the support portion 210 and may be exposed to the first surface 101 of the body 100. The second end portion 222 may extend from the support portion 210 and may be exposed to the second surface 102 of the body 100. The third end portion 223 may extend from the support portion 210 and may be exposed to the third surface 103 of the body 100.

The support substrate 200 may be formed of an insulating material including a thermosetting insulating resin such as an epoxy resin, a thermoplastic insulating resin such as a polyimide, or a photosensitive insulating resin, or may be formed of an insulating material including a reinforcing material such as a glass fiber or an inorganic filler with the above-described insulating resin. For example, the support substrate 200 may be formed of a material such as prepreg, Ajinomoto Build-up Film (ABF), FR-4, a bismaleimide triazine (BT) resin, a photoimageable dielectric (PID), a copper clad laminate (CCL) and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide improved stiffness. When the support substrate 200 is formed of an insulating material which does not include a glass fiber, the support substrate 200 may reduce a thickness of the coil portion 300 such that a thickness of the coil component 1000 in the one embodiment may be reduced. Alternatively, with reference to the same component size, the support substrate 200 may increase a volume of the body 100 (a volume of a magnetic material).

The coil portion 300 may be embedded in the body 100 and may exhibit properties of a coil component. For example, when the coil component 1000 is used as a power inductor, the coil portion 300 may store an electrical field as a magnetic field and may maintain an output voltage, thereby stabilizing power of an electronic device.

The coil portion 300 may be formed on at least one of both surfaces of the support substrate 200, and may format least one turn. In the example embodiment, the coil portion 300 may include first and second coil patterns 311 and 312 formed on the both surfaces of the support substrate 200 opposing each other in the thickness direction T of the body 100, and a via 320 penetrating the support substrate 200 and each of the insulating layers 410 and 420 to connect the first and second coil patterns 311 and 312 to each other.

Each of the first coil pattern 311 and the second coil pattern 312 may have a planar spiral shape forming at least one turn with reference to the core 110 of the body 100 as an axis. As an embodiment, the first coil pattern 311 may form at least one turn with reference to the core 110 as an axis on a lower surface of the support substrate 200, and the second coil pattern 312 may form at least one turn with reference to the core 110 as an axis on an upper surface of the support substrate 200.

End portions of the first and second coil patterns 311 and 312 may be connected to the first and second external electrodes 710 and 720, respectively. Accordingly, the first lead-out portion 311', one end portion of the first coil pattern 311, may extend to be exposed to the first surface 101 of the body 100 and may be in contact with and connected to the first external electrode 710 disposed on the first surface 101 of the body 100. The second lead-out portion 312', one end portion of the second coil pattern 312, may extend to be exposed to the second surface 102 of the body 100 and may be in contact with and connected to the second external electrode 720 disposed on the second surface 102 of the body 100.

The via 320 may connect the other end portion of the first coil pattern 311 to the other end portion of the second coil pattern 312. The via 320 may be spaced apart from the shielding pattern 500. Also, the first and second coil patterns 311 and 312 may be spaced apart from the shielding pattern 500 by the insulating layers 410 and 420. Accordingly, the shielding pattern 500 and the coil portion 300 may not be electrically connected to each other.

At least one of the coil patterns 311 and 312 and the via 320 may include one or more conductive layers. As an example, when the second coil pattern 312 and the via 320 are formed on the other surface of the support substrate 200 by a plating process, each of the second coil pattern 312 and the via 320 may include a seed layer and an electrolytic plating layer. The seed layer may be formed by an electroless plating method or a vapor deposition method such as sputtering method. Each of the seed layer and the electrolytic plating layer may have a single layer structure or a multilayer structure. The electrolytic plating layer having a multilayer structure may be formed in conformal film structure in which an electrolytic plating layer is covered by another electrolytic plating layer, or a structure in which an electrolytic plating layer is only layered on one surface of one of the electrolytic plating layers. The seed layer of the second coil pattern 312 and the seed layer of the via 320 may be integrated with each other such that a boundary may not be formed therebetween, but an example embodiment thereof is not limited thereto. The electrolytic plating layer of the second coil pattern 312 and the electrolytic plating layer of the via 320 may be integrated with each other such that a boundary may not be formed therebetween, but an example embodiment thereof is not limited thereto.

The coil patterns 311 and 312 and the via 320 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

The insulating layers 410 and 420 may be disposed between the support substrate 200 and the coil portion 300, and may extend to one surface of the shielding pattern 500 connected to one side surface of the shielding pattern 500 which opposes the internal wall of the through-hole H. Accordingly, with reference to the direction illustrated in FIGS. 2 and 3, the first insulating layer 410 may be disposed between a lower surface of the support substrate 200 and the first coil pattern 311 and may extend to cover a lower surface of the shielding pattern 500, and the second insulating layer 420 may be disposed between an upper surface of the support substrate 200 and the second coil pattern 312 and may extend to cover an upper surface of the shielding pattern 500. The central portion 510 of the shielding pattern 500 may have one side surface in contact with the internal wall of the through-hole H and the other side surface opposing the one side surface and directed to the core 110, and the insulating layers 410 and 420 in one embodiment may extend only to the one surface and the other surface (the upper surface and the lower surface with reference to the direction in FIGS. 2 and 3) of the shielding pattern 500, and may not extend to the other side surface of the shielding pattern 500.

The insulating layers 410 and 420 may be formed of an insulating material including a thermosetting insulating resin such as an epoxy resin, a thermoplastic insulating resin such as a polyimide, or a photosensitive insulating resin, or may be formed of an insulating material including a reinforcing material such as a glass fiber or an inorganic filler with the above-described insulating resin. As an example, the insulating layers 410 and 420 may be formed by layering a film-type insulating material, such as an Ajinomoto Build-up Film (ABF), a photoimageable dielectric film, or the like, on each of both surfaces of the support substrate 200 on which the shielding pattern 500 is formed, but an example embodiment thereof is not limited thereto. As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

The insulating film 600 may be disposed along surfaces of the coil portion 300 and the insulating layers 410 and 420, and may extend to a region between the shielding pattern 500 and the core 110. The insulating film 600 may protect each of the coil patterns 311 and 312, and may insulate the coil patterns 311 and 312 from the body 100. In one embodiment, the insulating film 600 may be formed along surfaces of the coil patterns 311 and 312, the insulating layers 410 and 420, and the shielding pattern 500 such that the insulating film 600 may be disposed between the other side surface of the shielding pattern 500 and the core 110. The insulating film 600 may include an insulating material such as parylene, but an example embodiment thereof is not limited thereto. The insulating film 600 may be formed by a vapor deposition method, or the like, but an example of the method is not limited thereto.

The first and second external electrodes 710 and 720 may be disposed on the first and second surfaces 101 and 102 of the body 100, respectively, and may be connected to the first coil pattern 311 and the second coil pattern 312, respectively. Accordingly, the first external electrode 710 may be disposed on the first surface 101 of the body 100 and may be in contact with and connected to the first lead-out portion 311', one end portion of the first coil pattern 311, exposed to the first surface 101 of the body 100. The second external electrode 720 may be disposed on the second surface 102 of the body 100, and may be in contact with and connected to the second lead-out portion 312', one end portion of the second coil pattern 312, exposed to the second surface 102 of the body 100. The first and second external electrodes 710 and 720 may be configured to extend from the first and second surfaces 101 and 102 of the body 100, respectively, to the sixth surface 106 of the body 100. The first and second external electrodes 710 and 720 may also be configured to extend from the first and second surfaces 101 and 102 of the body 100, respectively, to a portion of each of the third, fourth, and fifth surfaces 103, 104, and 105 of the body 100. The forms of the first and second external electrodes 710 and 720 illustrated in FIG. 1 and other diagrams are merely one examples, and each of the first and second external electrodes 710 and 720 may be configured to have an L-shaped form, or various other forms, without extending to a portion of each of the third, fourth, and fifth surfaces 103, 104, and 105 of the body 100.

The third external electrode 730 may be disposed on the third surface 103 of the body 100 and may be in contact with and connected to the connection portion 520 of the shielding pattern 500. The third external electrode 730 may be configured to extend from the third surface 103 of the body 100 to the sixth surface 106 of the body 100. The form of the third external electrode 730 illustrated in FIGS. 1 and 3 are merely an example, and the third external electrode 730 may be configured to extend to only a portion of the sixth surface 106 of the body 100 in the width direction W.

In one embodiment, the external electrodes 710, 720, and 730 may electrically connect the coil component 1000 to a mounting substrate when the coil component 1000 is mounted on the mounting substrate such as a printed circuit board. As an example, the coil component 1000 in one embodiment may be mounted such that the sixth surface 106 of the body 100 may be directed to an upper surface of a printed circuit board, and the external electrodes 710, 720, and 730 extended to the sixth surface 106 of the body 100 may be electrically connected to a connection portion of the printed circuit board by a conductive bonding member such as solder, or the like.

The external electrodes 710, 720, and 730 may include at least one of a conductive resin layer and an electrolytic plating layer. The conductive resin layer may be formed by a paste printing method, a dipping method, or the like, and may include one or more conductive metals selected from a group consisting of copper (Cu), nickel (Ni), and silver (Ag), and a thermosetting resin. The electrolytic plating layer may include one or more materials selected from a group consisting of nickel (Ni), copper (Cu), and tin (Sn).

As compared to the example in which an electromagnetic interference (EMI) shielding pattern is formed on an upper surface and a lower surface of a support substrate, in one embodiment, the shielding pattern 500 may not be formed on an upper surface and a lower surface of the support substrate 200. Also, in one embodiment, as the shielding pattern 500 is formed by a plating process, the shielding pattern 500 may have a relatively thin line width (a width of the central portion 510 of the shielding pattern in the direction L in FIG. 2 or the direction W in FIG. 3). Accordingly, in the coil component 1000, significant reduction of a volume of a magnetic material may be prevented when noise transferred to the components and/or noise generated from the components is removed. In other words, when the EMI shielding pattern is formed on an upper surface and a lower surface of a support substrate with reference to the same component size, a volume of a body (a volume of a magnetic material) may be reduced due to a volume occupied by the EMI shielding pattern. However, in one embodiment, as the shielding pattern 500 is disposed between the through-hole H of the support substrate 200 and the core 110 and has a relatively thin line width, and the shielding pattern 500 is not formed on the upper surface and the lower surface of the support substrate 200, a volume of the shielding pattern 500 may be reduced. Accordingly, significant reduction of a volume of the body 100 may be prevented.

Second Embodiment

Figure 5:
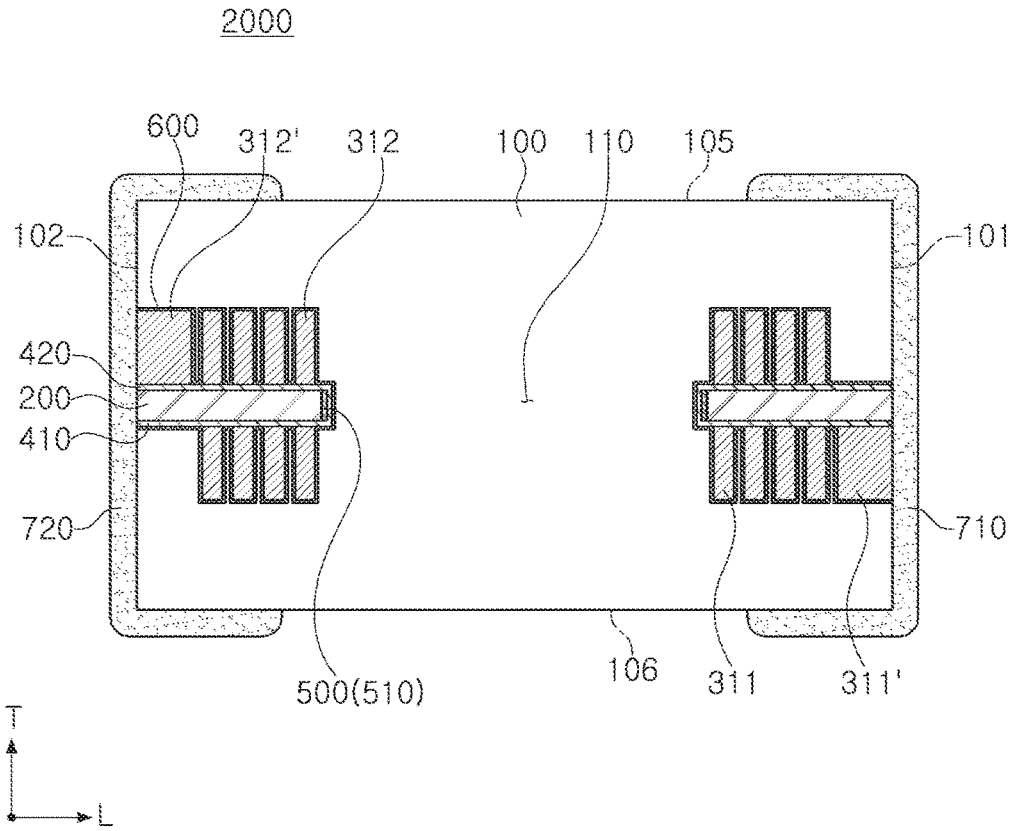
FIG. 5 is a diagram illustrating a coil component according to a second embodiment of the present disclosure, corresponding to a cross-sectional surface along line I-I' in FIG. 1.
Figure 6:
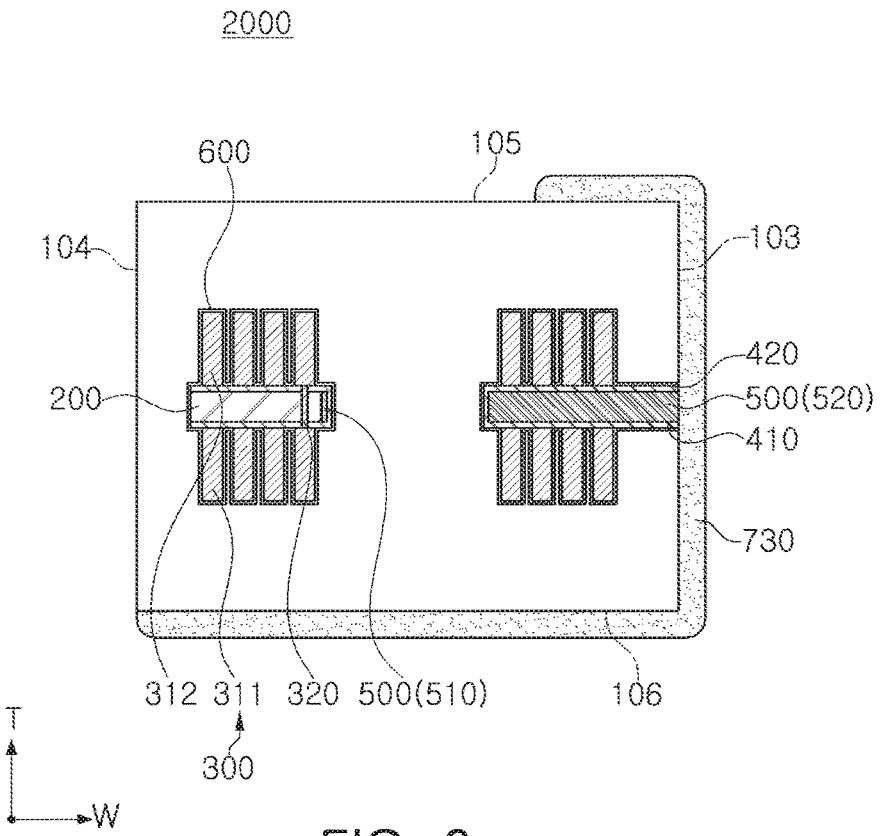
FIG. 6 is a diagram illustrating a coil component according to a second embodiment of the present disclosure, corresponding to a cross-sectional surface along line II-II' in FIG. 1.

FIG. 5 is a diagram illustrating a coil component according to a second embodiment, corresponding to a cross-sectional surface along line I-I' in FIG. 1. FIG. 6 is a diagram illustrating a coil component according to a second embodiment, corresponding to a cross-sectional surface along line II-II' in FIG. 1

Referring to FIGS. 1 to 4, and FIGS. 5 and 6, in a coil component 2000 in one embodiment, dispositional positions of the insulating layers 410 and 420 may be different from those of the coil component 1000 of the first embodiment. Accordingly, in the description of the embodiment, only the insulating layers 410 and 420 different from those of the first embodiment will be described. The descriptions of the other elements may be the same as in the first embodiment.

Referring to FIGS. 5 and 6, the insulating layers 410 and 420 in one embodiment may further extend to a region between the shielding pattern 500 and the core 110. For example, the insulating layers 410 and 420 may extend to a region between the other side surface of the central portion 510 of the shielding pattern 500 and the core 110.

In the case in which the insulating film 600 is interposed between the other side surface of the central portion 510 of the shielding pattern 500 and the core 110, it may be difficult to secure electrical insulation between the body 100 and the shielding pattern 500 due to a relatively thin thickness of the insulating film 600 according to a specific method for forming the insulating film 600. In one embodiment, as the insulating layers 410 and 420 disposed on the upper surface and the lower surface of the support substrate 200 are extended to a region between the other side surface of the central portion 510 of the shielding pattern 500 and the core 110 with reference to the direction in FIGS. 5 and 6, the above-described issue may be addressed.

Accordingly, electrical insulation between the shielding pattern 500 and the core 110 may be secured.

The different dispositional positions of the insulating layers 410 and 420, applied to the coil components 1000 and 2000 according to the first and second embodiments, respectively, may be varied in accordance with a design of a trimming process performed on the support substrate 200 after the coil portion 300 is formed.

Third Embodiment

Figure 7:
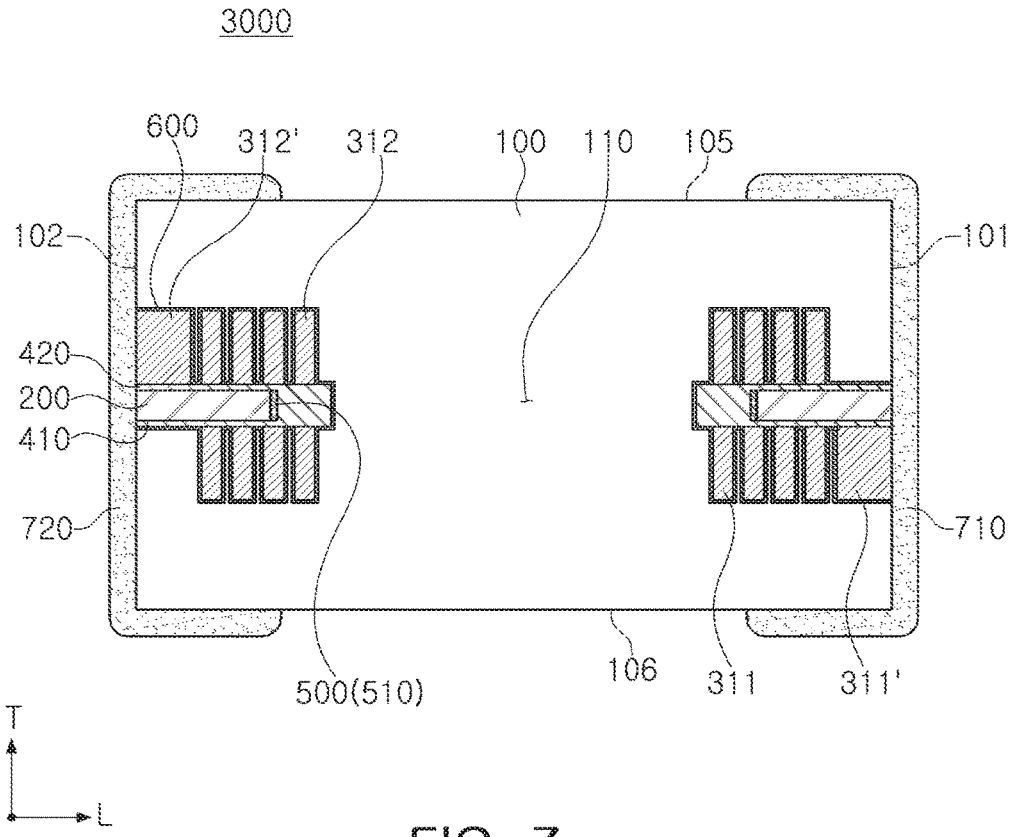
FIG. 7 is a diagram illustrating a coil component according to a third embodiment of the present disclosure, corresponding to a cross-sectional surface along line I-I' in FIG. 1.
Figure 8:
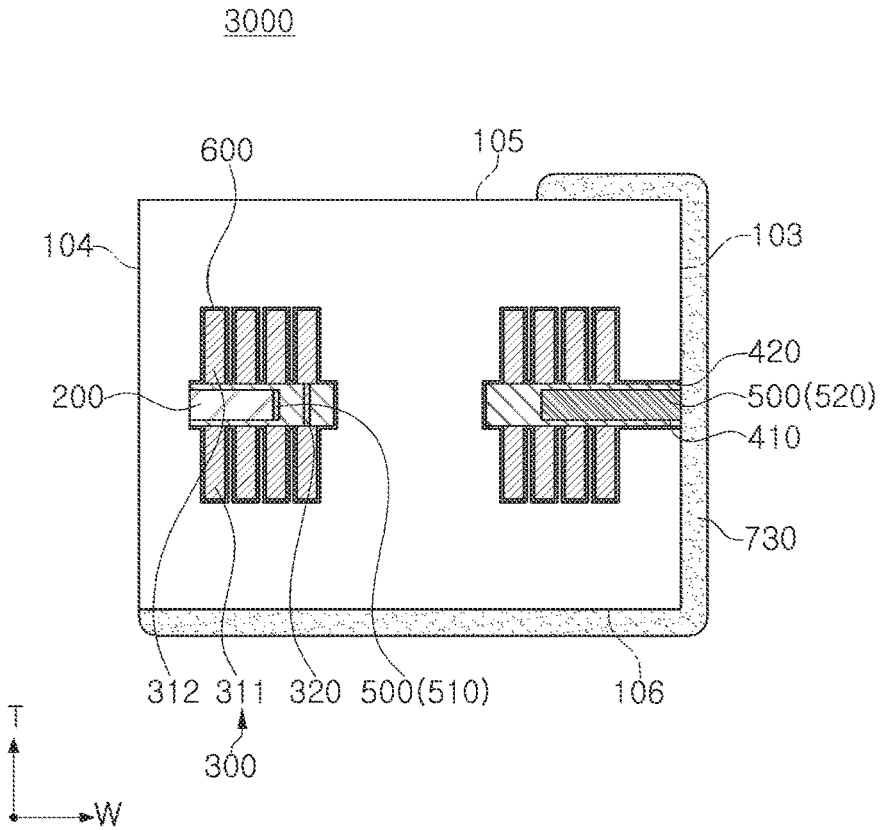
FIG. 8 is a diagram illustrating a coil component according to a third embodiment of the present disclosure, corresponding to a cross-sectional surface along line II-II' in FIG. 1.

FIG. 7 is a diagram illustrating a coil component according to a third embodiment, corresponding to a cross-sectional surface along line I-I' in FIG. 1. FIG. 8 is a diagram illustrating a coil component according to a third embodiment, corresponding to a cross-sectional surface along line II-II' in FIG. 1.

Referring to FIGS. 1 to 6 and FIGS. 7 and 8, in a coil component 3000 in one embodiment, a dispositional position of the shielding pattern 500 may be different from those of the coil components 1000 and 2000 of the first and second embodiments. Accordingly, in the description of the embodiment, only the dispositional position of the shielding pattern 500, different from those of the first and second embodiments, will be described. The descriptions of the other elements may be the same as in the first or second embodiments.

Referring to FIGS. 7 and 8, as for the shielding pattern 500 in one embodiment, at least a portion of the central portion 510 thereof may be disposed in a lower portion of at least a portion of a plurality of turns of the coil portion 300. Accordingly, in one embodiment, when the shielding pattern 500 and the coil portion 300 are projected in the thickness direction T of the body, at least a portion of the central portion 510 of the shielding pattern 500 may overlap at least a portion of the coil portion 300.

As at least a portion of the central portion 510 is disposed in a lower portion of at least a portion of the plurality of turns of the coil portion 300, noise generated from the component may be removed effectively. In other words, noise generated by the components may have different frequencies in different positions of the plurality of turns of the coil portion 300, a conductor, and in the example embodiment, as at least a portion of the central portion 510 of the shielding pattern 500 for removing noise is disposed to overlap the coil portion 300, noise may be selectively removed for each different frequencies.

FIGS. 7 and 8 illustrates the example in which each of the first and second coil patterns 311 and 312 has an innermost turn adjacent to the core 110, an outermost turn, and one or more intermediate turns disposed between the innermost turn and the outermost turn, and the central portion 510 of the shielding pattern 500 may overlap a second turn of each of the first and second coil patterns 311 and 312 in a direction from the innermost turn towards the outermost turn of each of the first and second coil patterns 311 and 312, but an example embodiment thereof is not limited thereto. In other words, differently from the example illustrated in FIGS. 7 and 8, an overall region of the central portion 510 of the shielding pattern 500 may overlap another turn, rather than the second turn, in accordance with an operation frequency of the coil component 3000 of one embodiment and a frequency of noise which may need to be removed. Alternatively, a portion of the central portion 510 of the shielding pattern 500 may overlap an nth turn (n is a positive integer, excluding 0), another portion thereof may overlap an n+1th turn, and the other portion thereof may overlap the insulating layers 410 and 420 and the insulating film 600 disposed between the nth turn and the n+1th turn.

According to the aforementioned embodiments, the coil component may prevent significant reduction of a volume of a magnetic material when noise generated by the components and/or transferred to the components is removed.

While the exemplary embodiments have been shown and described above, it will be apparent to those skilled in the art that modifications and variations could be made without departing from the scope of the present invention as defined by the appended claims.

What is claimed is:

1. A coil component, comprising:

a support substrate including a through-hole disposed therein;

a body including the support substrate embedded therein, and having a core disposed in the through-hole of the support substrate;

a coil portion disposed on the support substrate, embedded in the body, and having a plurality of turns with reference to the core as an axis on the support substrate; and a shielding pattern disposed between an internal wall of the support substrate, by which the through-hole is defined, and the core, wherein the shielding pattern extends inward of an innermost portion of the coil portion relative to the axis.

2. The coil component of claim 1, wherein the shielding pattern includes:

a central portion disposed between the internal wall of the support substrate and the core; and a connection portion extending from the central portion to a surface of the body.

3. The coil component of claim 2, wherein the central portion of the shielding pattern is disposed along the internal wall of the support substrate as a closed loop in the through-hole.

4. The coil component of claim 2, wherein at least a portion of the central portion of the shielding pattern overlaps at least a portion of the plurality of turns of the coil portion.

5. The coil component of claim 1, wherein the shielding pattern includes:

a seed layer disposed along the internal wall of the support substrate; and a plating layer disposed on the seed layer.

6. The coil component of claim 1, wherein the coil portion and the shielding pattern are not electrically connected to each other.

7. The coil component of claim 1, wherein a thickness of the shielding pattern is substantially the same as a thickness of the support substrate in a direction in which the coil portion is disposed on the support substrate.

8. The coil component of claim 1, further comprising:

an insulating layer disposed between the support substrate and the coil portion, and extending onto a first surface of the shielding pattern connected to one side surface of the shielding pattern which opposes the internal wall of the support substrate.

9. The coil component of claim 8, wherein the insulating layer further extends to a region between the shielding pattern and the core.

10. The coil component of claim 8, further comprising:

an insulating film disposed along surfaces of the coil portion and the insulating layer, and extending to a region between the shielding pattern and the core.

11. The coil component of claim 8, wherein the coil portion includes a first coil pattern and a second coil pattern disposed on a first surface and a second surface of the support substrate opposing each other, respectively, and wherein the insulating layer includes:

a first insulating layer disposed between the first surface of the support substrate and the first coil pattern and extending to the first surface of the shielding pattern; and a second insulating layer disposed between the second surface of the support substrate and the second coil pattern and extending to a second surface of the shielding pattern opposing the first surface of the shielding pattern.

12. The coil component of claim 11, further comprising:

a via penetrating the support substrate, the first insulating layer, and the second insulating layer to connect the first coil pattern to the second coil pattern, and spaced apart from the shielding pattern.

13. A coil component, comprising:

a support substrate including a through-hole disposed in a central portion thereof;

a coil portion disposed on the support substrate;

a shielding pattern disposed along an internal wall of the support substrate by which the through-hole is defined;

an insulating layer disposed between the support substrate and the coil portion, and extending to at least a portion of a surface of the shielding pattern; and a body including the support substrate, the coil portion, the shielding pattern, and the insulating layer, wherein a portion of the body is disposed in a remaining space of the through-hole in which the shielding pattern is disposed, wherein the shielding pattern has a line width narrower than a line width of the coil portion.

14. The coil component of claim 13, wherein the insulating layer extends to a region between the portion of the body disposed in the through-hole and the shielding pattern.

15. The coil component of claim 13, wherein the coil portion includes a plurality of turns with reference to the portion of the body disposed in the through-hole as an axis.

16. The coil component of claim 13, wherein the shielding pattern includes:

a central portion disposed between the internal wall of the support substrate and the portion of the body disposed in the through-hole; and a connection portion extending from the central portion to an external surface of the body.

17. The coil component of claim 16, wherein at least a portion of the central portion of the shielding pattern overlaps at least a portion of the plurality of turns of the coil portion in a direction in which the coil portion is disposed on the support substrate.

18. The coil component of claim 16, wherein an entire portion of the central portion of the shielding pattern is disposed closer to a center axis of the body than the plurality of turns of the coil portion.

19. A coil component, comprising:

a support substrate including a through-hole disposed therein;

a body including the support substrate embedded therein defining an interface therebetween, and having a core disposed in the through-hole of the support substrate;

a coil portion disposed on the support substrate and embedded in the body;

a shielding pattern disposed between an internal wall of the support substrate, by which the through-hole is defined, and the core;

first and second external electrodes disposed on both end surfaces of the body and connected to opposing ends of the coil portion; and a third external electrode disposed on an external surface of the body and spaced apart from the first and second external electrodes, wherein the shielding pattern extends and penetrates the support substrate to be exposed to the external surface of the body and connected to the third external electrode.

20. The coil component of claim 19, wherein the external surface of the body is a side surface of the body connecting the both end surfaces of the body, and a portion of the support substrate protrudes from a main portion of the support substrate, on which the coil portion is disposed, to be exposed to the third external electrode through the side surface of the body.

* * * * *